US011319865B2

(12) United States Patent
Jeong

(10) Patent No.: US 11,319,865 B2
(45) Date of Patent: May 3, 2022

(54) INTEGRATED TYPE RESERVOIR FOR VEHICLE

(71) Applicants: Hyundai Motor Company, Seoul (KR); Kia Motors Corporation, Seoul (KR)

(72) Inventor: Seong-Bin Jeong, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/009,355

(22) Filed: Sep. 1, 2020

(65) Prior Publication Data

US 2021/0180505 A1 Jun. 17, 2021

(30) Foreign Application Priority Data

Dec. 16, 2019 (KR) ..... 10-2019-0167658

(51) Int. Cl.

| | |
|---|---|
| ***F01P 11/02*** | (2006.01) |
| ***F01P 11/18*** | (2006.01) |
| ***F01P 7/14*** | (2006.01) |
| ***F01P 3/12*** | (2006.01) |

(52) U.S. Cl.

CPC ..... *F01P 11/0238* (2013.01); *F01P 3/12* (2013.01); *F01P 7/14* (2013.01); *F01P 11/0214* (2013.01); *F01P 11/0285* (2013.01); *F01P 2007/146* (2013.01)

(58) Field of Classification Search

CPC ..... F01P 11/029; F01P 11/18

See application file for complete search history.

(56) References Cited

U.S. PATENT DOCUMENTS

| | | | | |
|---|---|---|---|---|
| 4,116,268 | A * | 9/1978 | Kruger | F28F 9/02 123/41.54 |
| 4,167,159 | A * | 9/1979 | Warman | F01P 3/2207 123/41.08 |
| 4,640,235 | A * | 2/1987 | Martin | F01P 11/18 123/41.03 |
| 4,739,730 | A * | 4/1988 | Jenz | F01P 11/029 123/41.27 |
| 2010/0238757 | A1* | 9/2010 | Capps | B01F 3/20 366/22 |
| 2012/0090348 | A1* | 4/2012 | O'Rourke | H05K 7/20927 62/434 |
| 2013/0108249 | A1* | 5/2013 | Krause | B67D 3/0022 392/465 |
| 2013/0333960 | A1* | 12/2013 | Kasperek | B65D 39/08 180/65.1 |
| 2017/0183131 | A1* | 6/2017 | Kishore Kumar | F01P 11/0238 |

* cited by examiner

*Primary Examiner* — Long T Tran

(74) *Attorney, Agent, or Firm* — Mintz Levin Cohn Ferris Glovsky and Popeo, P.C.; Peter F. Corless

(57) ABSTRACT

A reservoir for a vehicle is provided. The reservoir is accommodated in a body formed by joining an upper case and a lower case to each other. A high-pressure reservoir space introduces and discharges coolant flowing from a high pressure cooling line and a low-pressure reservoir space introduces and discharges coolant flowing from a low pressure cooling line. A valve is also installed to maintain internal pressure of the high-pressure reservoir space and the low-pressure reservoir space constant.

14 Claims, 14 Drawing Sheets

INTEGRATED TYPE RESERVOIR FOR VEHICLE

CROSS-REFERENCE TO RELATED APPLICATION

This application claims under 35 U.S.C. § 119(a) the benefit of Korean Patent Application No. 10-2019-0167658, filed on Dec. 16, 2019, the entire contents of which are incorporated herein by reference.

BACKGROUND

(a) Technical Field

The present disclosure relates to a reservoir of a vehicle, and more particularly, to an integrated type reservoir including, in a body made by joining an upper case and a lower case to each other, a high-pressure reservoir space configured to introduce and discharge coolant flowing from a high pressure cooling line, and a low-pressure reservoir space configured to introduce and discharge coolant flowing from a low pressure cooling line, and a valve installed to maintain internal pressure of the high-pressure reservoir space and the low-pressure reservoir space constant.

(b) Background Art

Generally, an engine cooling system of a vehicle includes a radiator configured to cool coolant that increases in temperature in an engine, a cooling fan configured to ventilate the radiator, a water pump configured to supply the coolant cooled in the radiator to a coolant passage of the engine, and a reservoir disposed in the coolant passage. The reservoir may also be referred to as a reservoir tank that stores a predetermined amount of coolant, and prevents negative pressure of the cooling system from being generated.

Moreover, as illustrated in FIG. 1 of the related art, a hybrid vehicle such as a Hybrid Electronic Vehicle (HEV) includes a cooling line for cooling an engine 1 and a cooling line for cooling various Power Electronic (PE) components 2 such as a motor, a direct current-direct current (DC-DC) converter, an inverter, or a high voltage battery. Therefore, the radiator of the cooling system is also separated into two radiators. One is a high-temperature radiator (HTR) 3 installed in the engine cooling line, and the other is a low-temperature radiator (LTR) 4 installed in the PE cooling line.

Furthermore, a reservoir (HTR RSVR) for the high-temperature radiator 5 is installed on a cooling line between the high-temperature radiator 3 and the engine 1, while a reservoir (LTR RSVR) for the low-temperature radiator 6 is installed on a cooling line between the low-temperature radiator 4 and the PE component 2. Reference numeral 7 denotes an electronic water pump (EWP) 7 installed between the low-temperature radiator reservoir 6 and the PE component 2. However, the related art is problematic in that two reservoirs, namely, the HTR RSVR 5 and the LTR RSVR 6 should be used as described above, thus increasing the cost and process time for manufacturing the two reservoirs.

Additionally, in the case of the cooling line for the engine 1, the pressure of the cooling line itself increases up to 1.1 bar. Thus, the specification of a cap for shielding the top of the HTR RSVR 5 used in the corresponding cooling line is set to be used at the pressure level of 1.1 bar. However, in the case of the cooling line for the PE component 2, the pressure of the cooling line itself is approximately 0.7 bar that is a pressure level lower than 1.1 bar. The cap of the LTR RSVR 6 used in the corresponding cooling line is used in common with the HTR RSVR 5 used in the engine cooling line. The reason is because it is difficult to dualize the specification of the cap used in the reservoir in terms of productivity. However, to efficiently exhaust the air from the cooling line for the PE component, the LTR RSVR 6 used in the cooling line for the PE component should reduce the pressure of the cap. Therefore, a method for decreasing the pressure of the cap is required.

SUMMARY

The present disclosure provides an integrated type reservoir that has a single reservoir to solve a problem of the related art in which two reservoirs should be installed in an engine cooling line and a PE cooling line. Furthermore, the disclosure provides an integrated type reservoir having a cap that may be used at both 1.1 bar that is the pressure of an engine cooling line and 0.7 bar that is the pressure of a PE cooling line. Additionally, the disclosure provides an integrated type reservoir capable of satisfactorily performing the unique functions of the reservoir, namely, the coolant injecting function of the reservoir, the function of discharging pressure at positive pressure, and the function of suctioning pressure at negative pressure.

According to one aspect of the disclosure, the present disclosure provides an integrated type reservoir of a vehicle that may include, in a body made by joining an upper case and a lower case to each other, a high-pressure reservoir space configured to introduce and discharge coolant flowing from a high pressure cooling line, and a low-pressure reservoir space configured to introduce and discharge coolant flowing from a low pressure cooling line, and a valve installed to maintain internal pressure of the high-pressure reservoir space and the low-pressure reservoir space constant.

The integrated type reservoir for the vehicle of the present disclosure configured as such solves a problem of the related art in which two reservoirs should be installed in the engine cooling line and the PE cooling line, thus reducing the number of the reservoirs to one, and thereby reducing a manufacturing cost and simplifying a manufacturing process. Furthermore, the present disclosure has an advantage in that it has a single reservoir, thus reducing the weight of a vehicle and improving fuel efficiency, and the reservoir takes up less space in an engine room compared to the related art using two reservoirs, and thus, space utilization is improved and the packaging of equipment is efficient. The present disclosure further has an advantage in that a low pressure part of the reservoir is used at the level of 0.7 bar, and thus, the overall pressure of the PE cooling line may be reduced to 0.7 bar, and thereby the durability of the PE cooling line may be increased due to pressure decrease, and the performance of exhausting the air may be improved.

BRIEF DESCRIPTION OF THE DRAWINGS

The above and other objects, features and advantages of the present disclosure will be more clearly understood from the following detailed description taken in conjunction with the accompanying drawings, in which.

DETAILED DESCRIPTION

Figure 1:
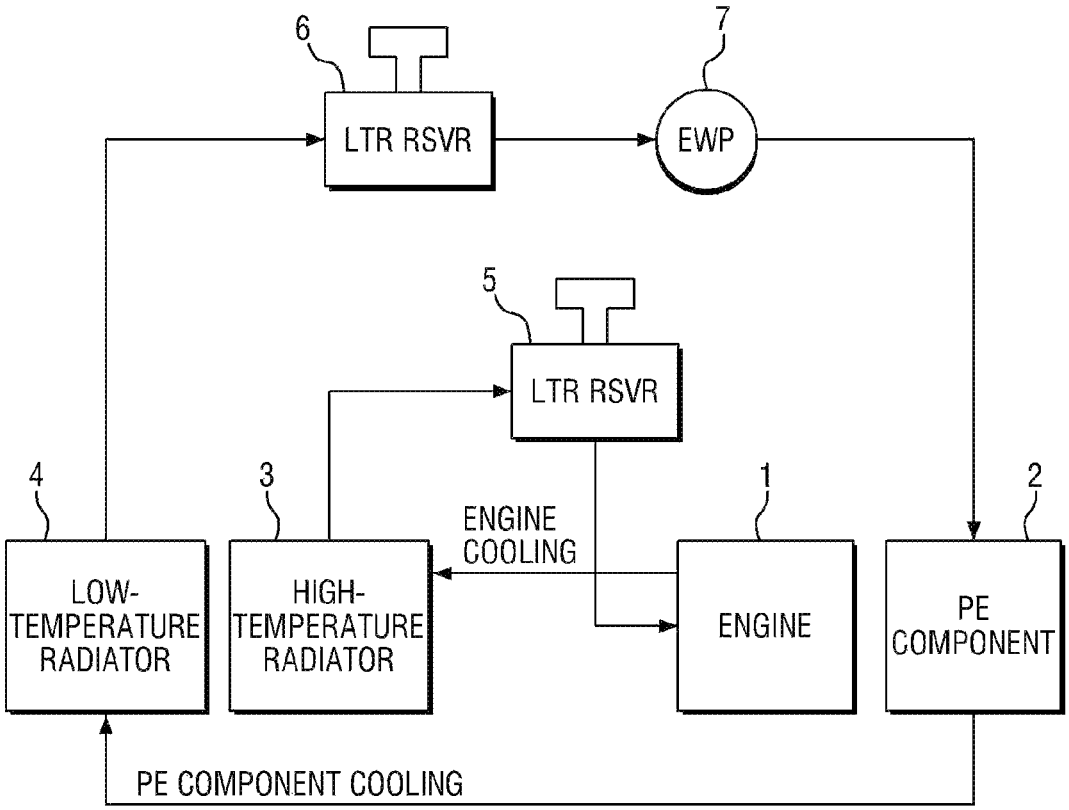
FIG. 1 RELATED ART
FIG. 1 is a diagram illustrating a configuration of a conventional cooling line system for a vehicle according to the related art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, the configuration and operation of an integrated type reservoir according to the present disclosure will be described in detail with reference to the accompanying drawings. However, the illustrated drawings are provided as an example to sufficiently convey the spirit of the present disclosure to those skilled in the art. Therefore, the present disclosure may be embodied in other aspects without being limited to the drawings presented below.

Furthermore, the terms used herein have a meaning understood commonly by those skilled in the art to which the disclosure belongs, unless otherwise specified. In the following description and accompanying drawings of the present disclosure, when it is determined that the related art of the present disclosure unnecessarily makes the gist of the present disclosure obscure, a detailed description thereof will be omitted.

Figure 2:
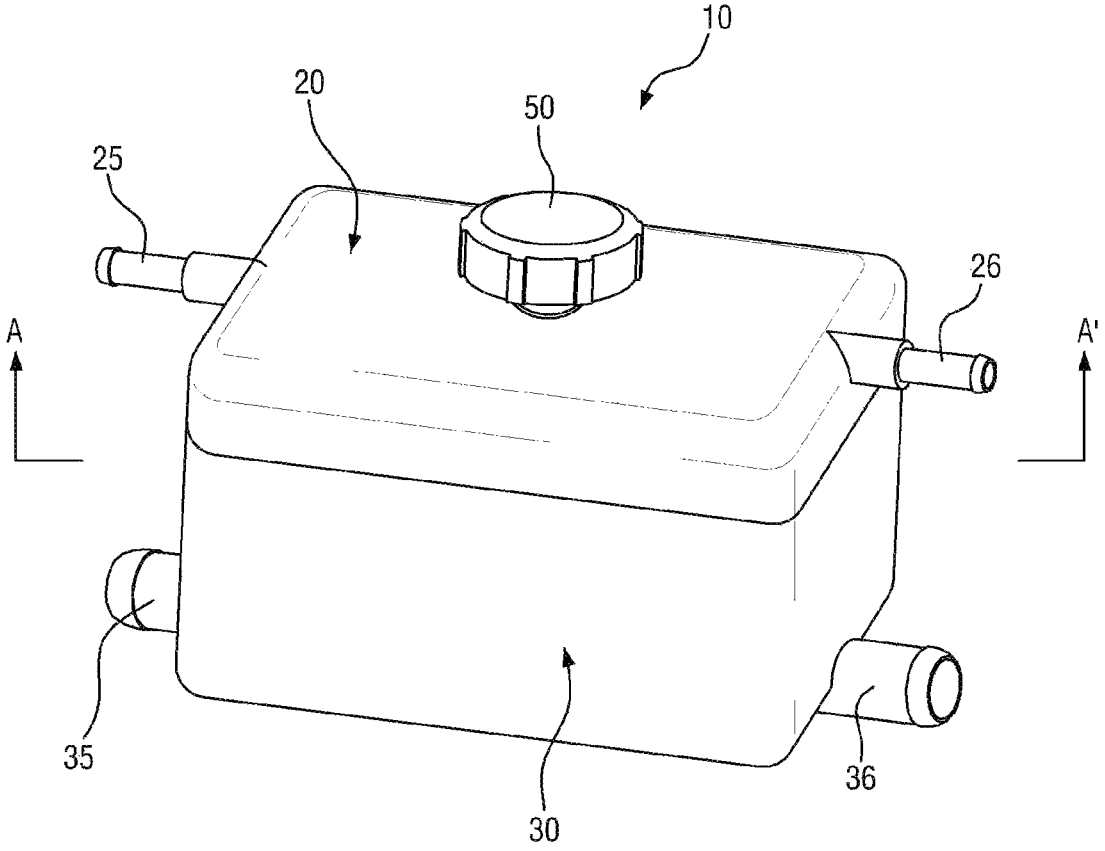
FIG. 2 is a perspective view illustrating an integrated type reservoir according to the present disclosure.
Figure 3A:
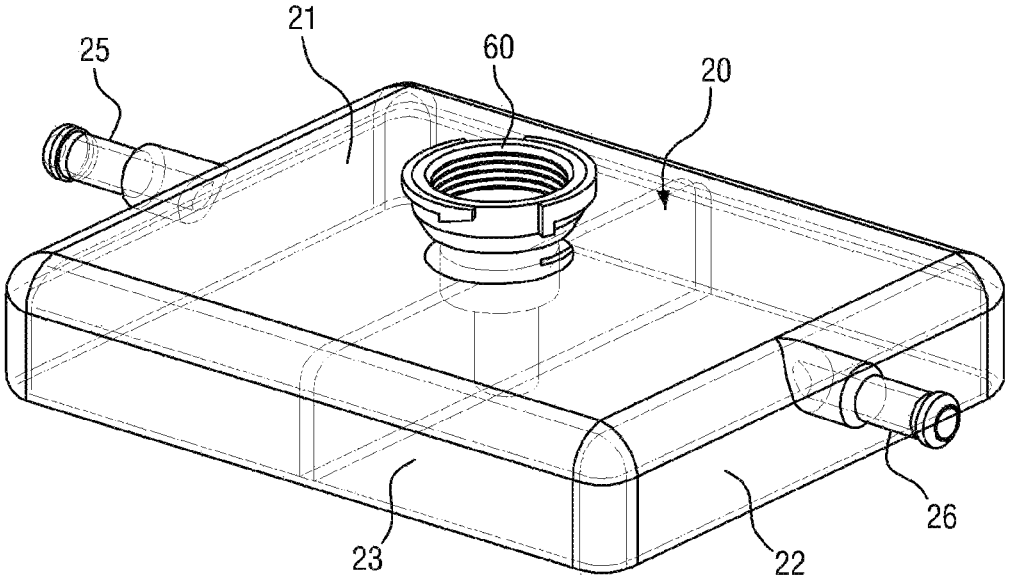
FIG. 3A is a detailed view of the upper case according to the present disclosure.
Figure 3B:
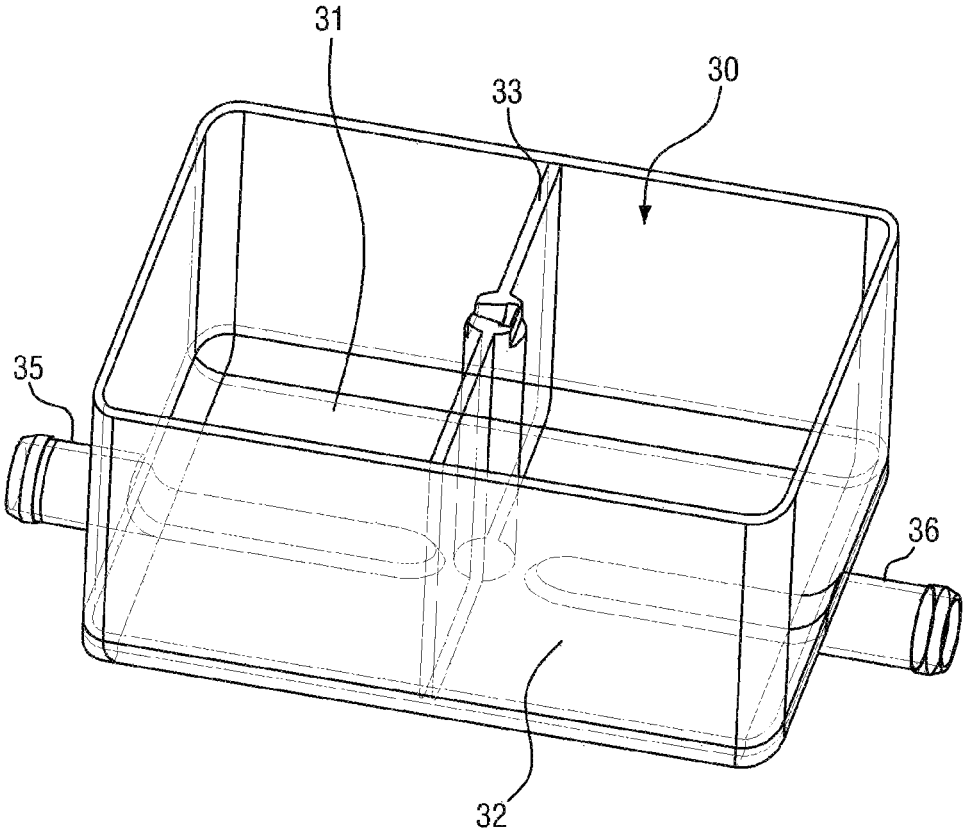
FIG. 3B is a detailed view of the lower case according to the present disclosure.
Figure 3C:
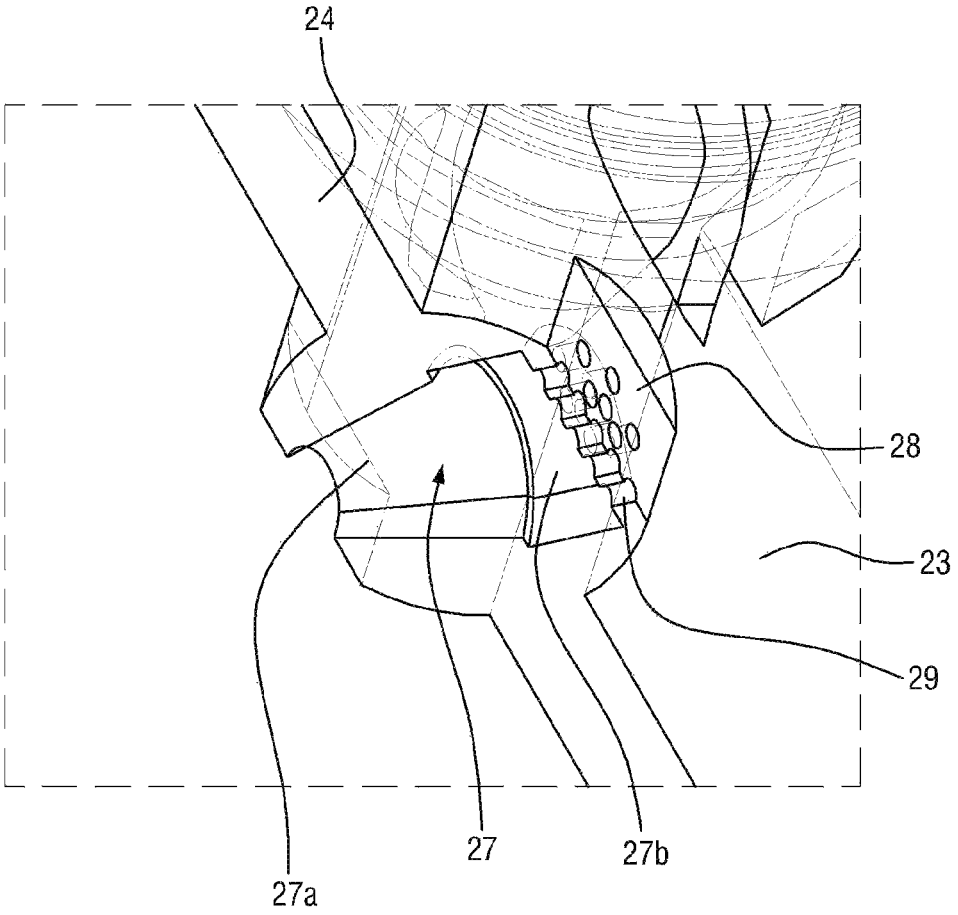
FIG. 3C is an enlarged sectional view of an end face of an upper partition wall according to the present disclosure.
Figure 3D:
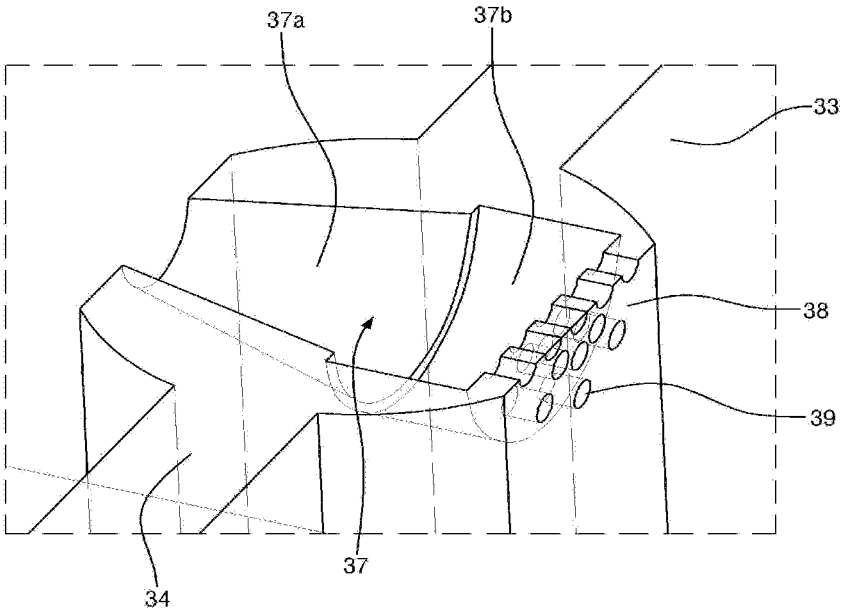
FIG. 3D is an enlarged sectional view of an end face of a lower partition wall according to the present disclosure.

FIG. 2 is a perspective view illustrating an integrated type reservoir according to the present disclosure. FIGS. 3A to 3D are detailed views illustrating an upper case and a lower case, in which FIG. 3A is a detailed view of the upper case, FIG. 3B is a detailed view of the lower case, FIG. 3C is an enlarged sectional view of an end face of an upper partition wall, and FIG. 3D is an enlarged sectional view of an end face of a lower partition wall. Referring to FIGS. 2 and 3A to 3D, the integrated type reservoir 10 of the present disclosure has a body made by joining an upper case 20 and a lower case 30 to each other.

The upper case 20 may include an upper plate 21, an edge 22 that extends downwards from each side of the upper plate 21 to be perpendicularly bent, and an upper partition wall 23 that extends downwards from a central portion of an inner surface of the upper plate 21 to be perpendicular thereto, thus forming an end face 24. The lower case 30 may include a lower plate 31, a sidewall surface 32 that extends upwards from each side of the lower plate 31 to be perpendicularly bent, and a lower partition wall 33 that extends upwards from a central portion of a surface of the lower plate 31 to be perpendicular thereto, thus forming an end face 34.

In the integrated type reservoir 10 according to an exemplary embodiment of the present disclosure, the upper case 20 and the lower case 30 may be joined to each other through thermal fusion. The upper case 20 and the lower case 30 may be secured to each other and then heated by a heat plate. When a fused portion is sufficiently melted, pressure is applied with the heat plate being removed. Subsequently, a cooling operation may be performed until the fused portion is hardened, to thus join the upper case 20 and the lower case 30 to each other.

Furthermore, when the upper case 20 and the lower case 30 are joined to each other through thermal fusion, the end face 24 of the upper partition wall 23 of the upper case 20 and the end face 34 of the lower partition wall 33 of the lower case 30 are attached to each other. An internal space of the integrated type reservoir 10 may be divided into two spaces by the upper partition wall 23 and the lower partition wall 33 which are attached to each other.

Figure 4:
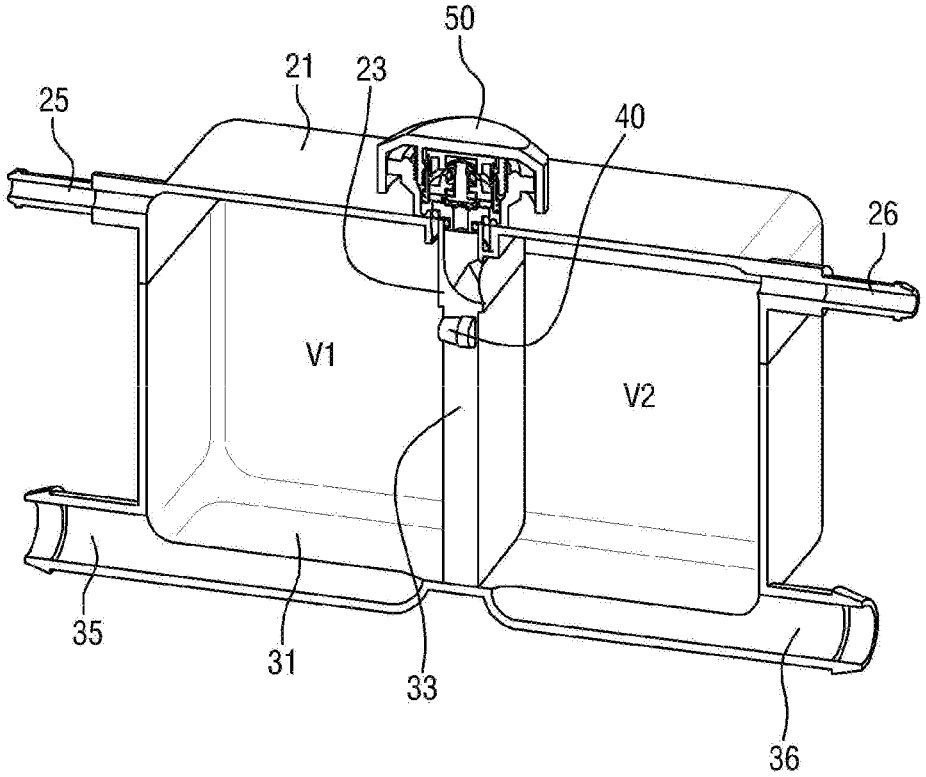
FIG. 4 is a sectional view taken along line A-A' of FIG. 2 to illustrate an internal section of the integrated type reservoir according to the present disclosure.

FIG. 4 is a sectional view taken along line A-A' of FIG. 2 to illustrate an internal section of the integrated type reservoir according to the present disclosure. Among the two divided spaces, one space defines a high-pressure reservoir space V1 of the reservoir 10 of the present disclosure, while the other space defines a low-pressure reservoir space V2 of the reservoir 10 of the present disclosure. According to the exemplary embodiment of the present disclosure, a space on the left side in the internal space shown in FIG. 4 when viewed from the front defines the high-pressure reservoir space V1, and a space on the right side when viewed from the front defines the low-pressure reservoir space V2.

Therefore, a first inlet pipe 25 may be formed on a first side of the upper case 20 to introduce coolant flowing from a high-temperature radiator 3 of an engine cooling line into the high-pressure reservoir space V1, and a second inlet pipe 26 may be formed on a second side of the upper case 20 to introduce coolant flowing from a low-temperature radiator 4 of a PE cooling line into the low-pressure reservoir space V2. Additionally, a first outlet pipe 35 may be formed on a first side of the lower case 30 to discharge coolant accommodated in the high-pressure reservoir space V1 to the cooling line of the engine 1, and a second outlet pipe 36 may be formed on a second side of the lower case 30 to discharge coolant accommodated in the low-pressure reservoir space V2 to the cooling line of the PE component 2.

Moreover, referring to FIGS. 3C and 3D, a valve insert groove 27 may be formed on the end face 24 of the upper partition wall 23 of the upper case 20 to seat an upper portion of the valve 40 thereon, and a valve insert groove 37 may be formed on the end face 34 of the lower partition wall 33 of the lower case 30 to set a lower portion of the valve 40 thereon. The valve insert grooves 27 and 37 may include release valve grooves 27*a* and 37*a* in which a release valve 41 of the valve 40 that will be described later is seated, and outer spring grooves 27*b* and 37*b* in which an outer spring 45 of the valve 40 is seated.

Thus, as illustrated in FIGS. 3C and 3D, when the upper partition wall 23 of the upper case 20 is attached with the lower portion of the valve 40 being inserted into the valve insert groove 37 of the lower partition wall 33, the upper portion of the valve 40 may be inserted into the valve insert groove 27 of the upper partition wall 23, and thus, the valve 40 may be attached to the upper partition wall 23 and the lower partition wall 33. The valve 40 may be coupled to a junction of the upper and lower partition walls 23 and 33 to regulate the internal pressure of each of the high-pressure reservoir space V1 and the low-pressure reservoir space V2 divided by the partition walls 23 and 33.

Furthermore, to cause air to flow from one space (e.g., the first space) to the other space (e.g., the second space) when the internal pressure of each of the spaces V1 and V2 is regulated by the valve 40, flow apertures 29 and 39 passing through the sidewalls 28 and 38 are formed, respectively, in the sidewall 28 of a portion in which the valve insert groove 27 of the upper partition wall 23 is formed, and the sidewall 38 of a portion in which the valve insert groove 37 of the lower partition wall 33 may be formed with a first side opened towards each of the sidewalls 28 and 38 and a second side opened towards each of the valve insert grooves 27 and 37.

Figure 5:
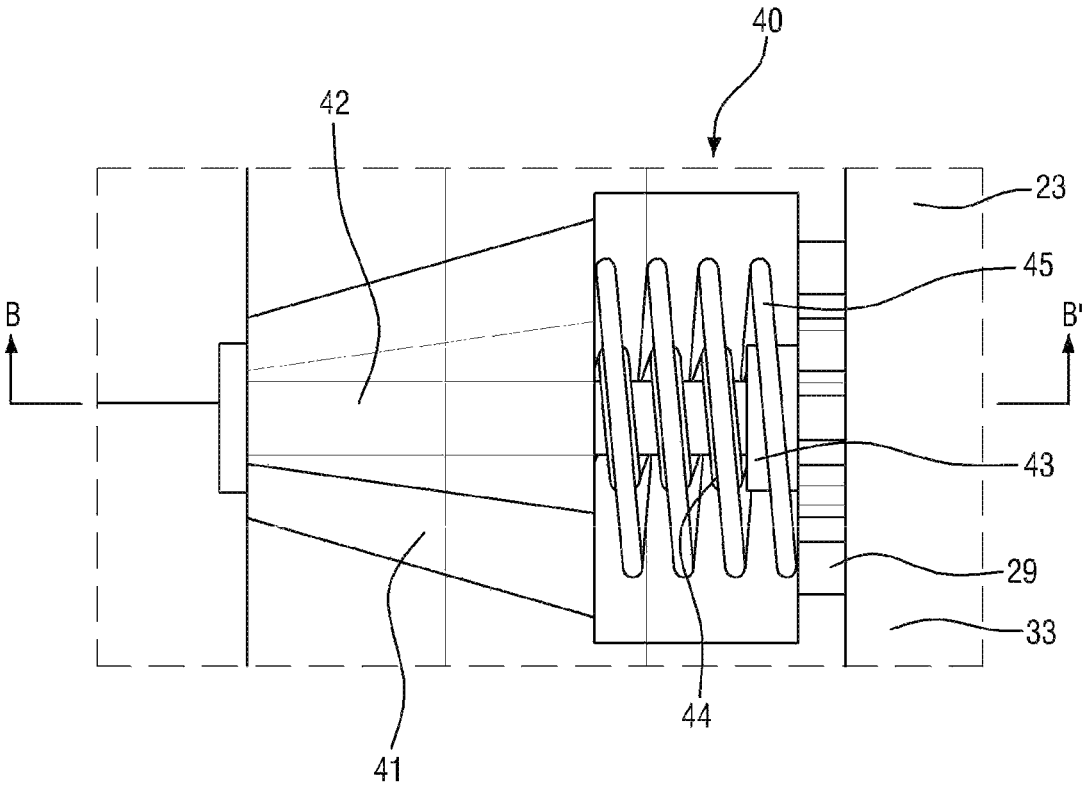
FIG. 5 is a side view of a valve of the integrated type reservoir according to the present disclosure.
Figure 6A:
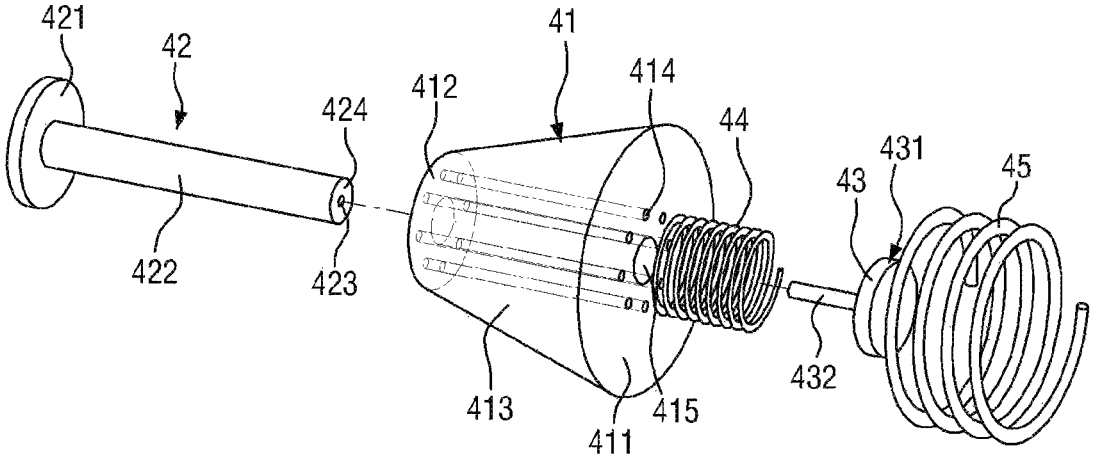
FIG. 6A is an exploded perspective view of the valve according to the present disclosure.
Figure 6B:
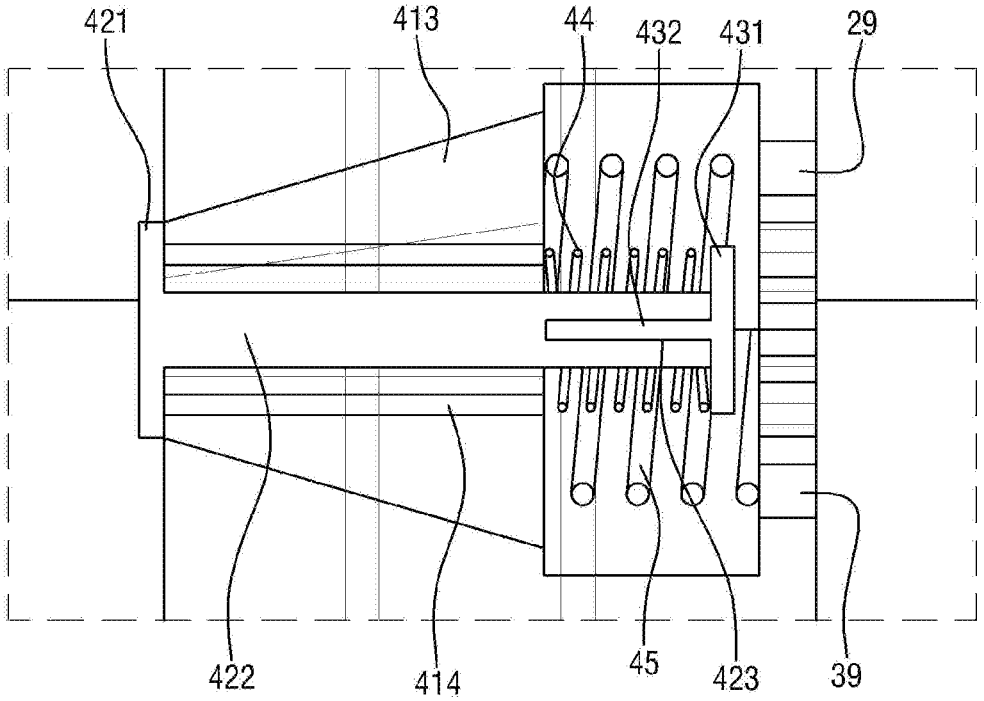
FIG. 6B is a sectional view taken along line B-B' of FIG. 5 to illustrate a section of the valve of the integrated type reservoir according to the present disclosure.
Figure 6C:
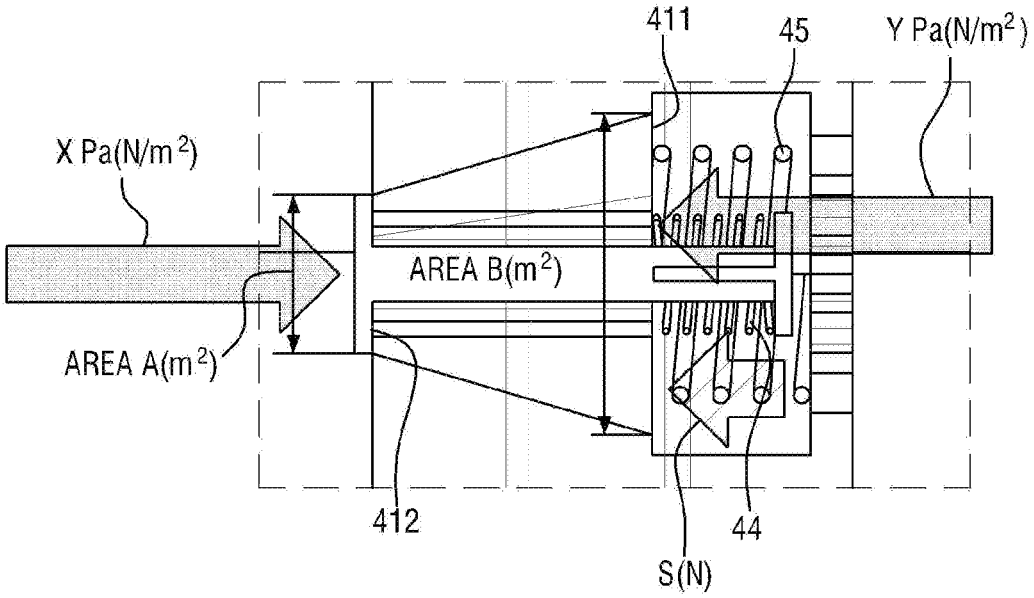
FIG. 6C is a sectional view illustrating an operating state of the valve of the integrated type reservoir according to the present disclosure.

The configuration of the valve 40 will be described below in detail. FIG. 5 is a side view of the valve of the integrated type reservoir according to the present disclosure. FIGS. 6A to 6C are detailed views of the valve of the integrated type reservoir according to the present disclosure, in which FIG. 6A is an exploded perspective view of the valve, FIG. 6B is a sectional view taken along line B-B' of FIG. 5 to illustrate a section of the valve of the integrated type reservoir according to the present disclosure, and FIG. 6C is a sectional view illustrating an operating state of the valve of the integrated type reservoir according to the present disclosure.

Referring to the respective drawings, the valve 40 includes the release valve 41. The release valve 41 has a body 413 with a bottom surface 411 and a top surface 412, an insert aperture 415 passing from the bottom surface 411 to the top surface 412 may be formed in a central portion of the body 413, and a plurality of vent apertures 414 may be formed around the insert aperture 415. Each vent aperture 414 may extend from the bottom surface 411 to the top surface 412. In this regard, a diameter of the bottom surface 411 is greater than a diameter of the top surface 412, and a diameter of the insert aperture 415 is greater than a diameter of the vent aperture 414. Thus, the release valve 41 may have a shape of a truncated cone.

Furthermore, the outer spring 45 may be disposed on the bottom surface 411 of the release valve 41. A first side of the outer spring 45 may face the bottom surface 411, while a second side of the outer spring 45 may face the sidewalls 28 and 38 of the insert grooves 27 and 37. Therefore, the release valve 41 may be rotated in left and right directions of a high-pressure reservoir space V1 direction and a low-pressure reservoir space V2 direction (hereinafter, for convenience, the high-pressure reservoir space V1 direction is referred to as a left direction, and the low-pressure reservoir space V2 direction is referred to as a right direction) in the internal spaces of the insert grooves 27 and 37 by the elastic force of the outer spring 45.

Additionally, a push valve 42 may be coupled to the insert aperture 415 of the release valve 41. The push valve 42 may include a flat plate-shaped upper piece 421 that opens or closes the vent aperture 415 on the top surface 412 of the release valve 41, and an arm 422 that extends downwards from a bottom surface of the upper piece 421 and has a pinhole 423 formed inwards from the end face 424. Particularly, a length A1 of the arm 422 is formed longer than a length L1 of the release valve 41. A pin body 43 may be coupled to the arm 422 of the push valve 42. The pin body 43 may include a head piece 431 that comes into contact with the end face 424 of the arm 422, and a pin 432 that extends downwards from a bottom surface of the head piece 431 and is inserted into the pinhole 423 of the arm 422.

Furthermore, the inner spring 44 may be fitted into the outer spring 45 on the bottom surface 411 of the release valve 41. A first side of the inner spring 44 may face the bottom surface 411, while a second side of the inner spring 44 may face the head piece 431 of the pin body 43. Therefore, the arm 422 of the push valve 42 may be rotated in the left and right directions in the insert aperture 415 of the release valve 41 by the elastic force of the inner spring 44.

Referring to FIG. 6C, the valve 40 of the present disclosure configured as described above may be disposed between the upper partition wall 23 and the lower partition wall 33 that partition the space into the high-pressure reservoir space V1 and the low-pressure reservoir space V2, thus automatically regulating the internal pressure of the high-pressure reservoir space V1 and the low-pressure reservoir space V2.

In other words, assuming that an area of the bottom surface 411 of the release valve 41 is referred to as an 'area B' (unit: $m^2$), an area of the top surface 412 is referred to as an 'area A' (unit: $m^2$), internal pressure of the high-pressure reservoir space V1 is referred to as an 'X' Pa (unit: $N/m^2$), and internal pressure of the low-pressure reservoir space V2 is referred to as a 'Y' Pa (unit: $N/m^2$), the internal pressure of each space may be regulated by the force balance equation such as the following equation 1.

$$X^*(\text{area } A)=Y^*(\text{area } B)+S \qquad \text{Equation 1}$$

* Legend

S: the elastic force of the inner spring (unit: N)

Therefore, in the integrated type reservoir 10 of the present disclosure, when the pressure of the low-pressure reservoir space V2 is set to about 0.7 bar, and the pressure of the high-pressure reservoir space V1 is set to about 1.1 bar, a cap usable at the level of about 0.7 bar pressure may be prepared as a cap 50 that will be described later. By setting the area of the top surface 412 of the release valve, the area of the bottom surface 411, and the elastic force of the inner spring to conform to the force balance equation of Equation 1, the internal pressure of the high-pressure reservoir space V1 and the low-pressure reservoir space V2 may be automatically regulated by the valve 40. The operation of the valve 40 will be described later.

Figure 7:
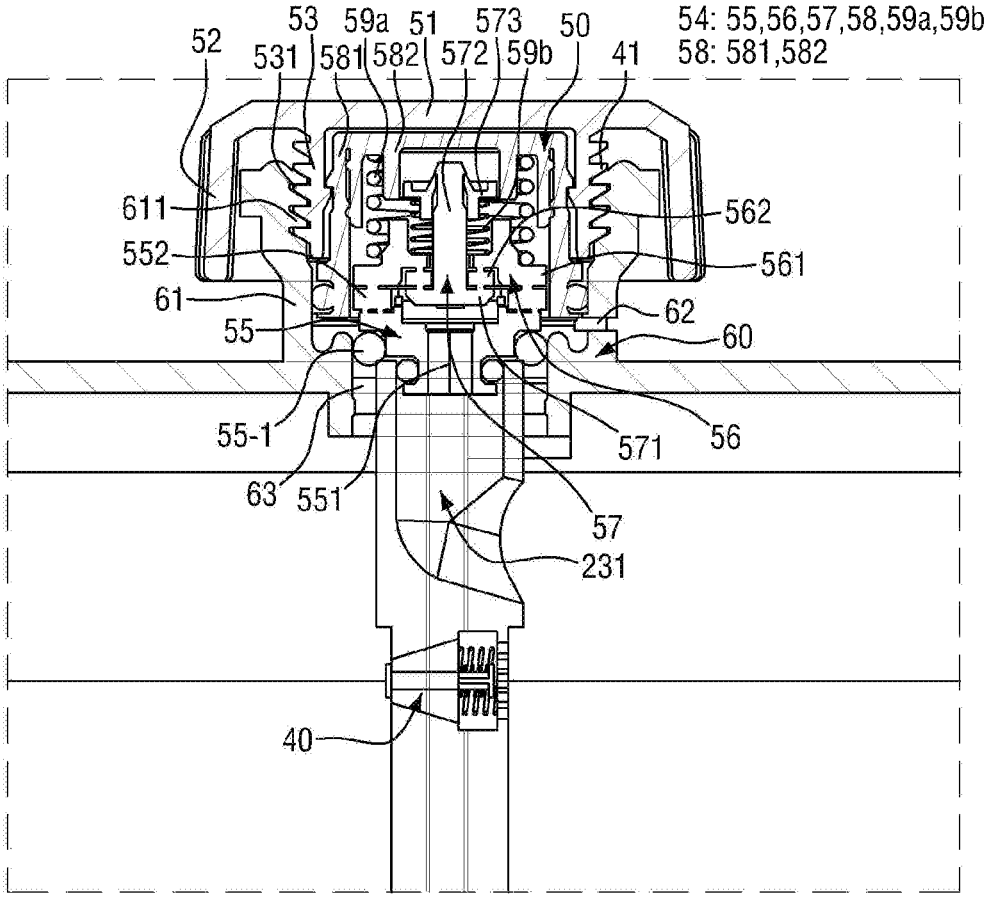
FIG. 7 is a sectional view of a cap of the integrated type reservoir according to the present disclosure.

FIG. 7 is a sectional view of the cap of the integrated type reservoir according to the present disclosure. Referring to the drawing, the cap 50 of the present disclosure is a member coupled to a cap coupler 60 that is provided on the upper plate 21 of the upper case 20. The cap 50 may be coupled to the cap coupler 60 to shield the internal space of the integrated type reservoir 10 according to the present disclosure from the outside. The cap 50 may regulate the internal pressure of the low-pressure reservoir space V2 in the state where the cap is coupled to the cap coupler 60.

Accordingly, the cap 50 may include a holder 51, a sidewall 53, and a cap valve part 54. The holder 51 may have a shape of a flat plate with an edge 52 that extends downwards and is held by a user's hand. The sidewall 53 may extend downwards from the holder 51, with a thread 531 formed thereon. The cap valve part 54 may be installed in the space defined inside the sidewall 53 to be opened or closed according to the internal pressure of the low-pressure reservoir space V2 and the high-pressure reservoir space V1 in the reservoir 10, thus discharging the air of the low-pressure reservoir space V2 to the outside of the cap 50 or introducing the external air into the low-pressure reservoir space V2.

In this regard, the cap valve part 54 may include a base 55, an intermediate body 56, an upper member 58, a main spring 59*a*, a cam 57, and a sub spring 59*b*. The base 55 may have a flow aperture 551 that is formed to communicate with a flow path 231 formed in the upper partition wall 23 to be opened towards the low-pressure reservoir space V2, with a first locking surface 552 being formed on an upper surface of the base. The intermediate body 56 may be installed on the top of the base 55, and has a lower surface 561 that comes into contact with the first locking surface 552, and a second locking surface 562 that extends into the lower surface 561 to come into contact with a head piece 571 of the cam 57. The upper member 58 may have an inner wall 581 coupled to the sidewall 53, and a ceiling surface 582 integrated with the inner wall 581.

The main spring 59*a* may be interposed between the top of the lower surface 561 of the intermediate body 56 and the ceiling surface 582 of the upper member 58 to rotate the intermediate body 56 upwards and downwards. The cam 57 may include a plate-shaped head piece 571 inserted into the intermediate body 56 to be locked by the second locking surface 562 of the intermediate body 56, and a piston 572 that extends upwards from the head piece 571. The sub spring 59*b* may be interposed between a ring body 573 through which the upper end of the piston 572 of the cam 57 passes and the head piece 571 of the cam 57 to rotate the cam 57 upwards and downwards.

To prevent the air of the high-pressure reservoir space V1 from leaking to the cap 50, an O-ring 55-1 for shielding a coolant refill aperture 63 of the high-pressure reservoir space V1 of the cap coupler 60, which will be described later, may be attached to the bottom of the base 55. Further, the cap coupler 60 provided on the upper case 20 may include a coupling wall 61 that has an internal thread 611 formed to be coupled with the cap 50 and extends upwards from the upper plate 21 of the upper case 20, and an orifice 62 formed through the coupling wall 61 to allow air to flow into the low-pressure reservoir space V2 of the integrated type reservoir 10. Moreover, the coolant refill aperture 63 may be formed through the upper plate 21 of the upper case 20 to refill the coolant into the high-pressure reservoir space V1.

In particular, if the cam 57 moves downwards, the external air of the integrated type reservoir 10 flows into the orifice 62, and then flows through the flow aperture 551 of the base 55 into the low-pressure reservoir space V2. On the contrary, if the cam 57 moves upwards, the air of the low-pressure reservoir space V2 passes through the flow aperture 551 of the base 55, and then may be discharged through the orifice 62 to the outside of the integrated type reservoir 10. An operation for regulating the pressure of the low-pressure reservoir space V2 through the orifice 62 will be described later.

Figure 8:
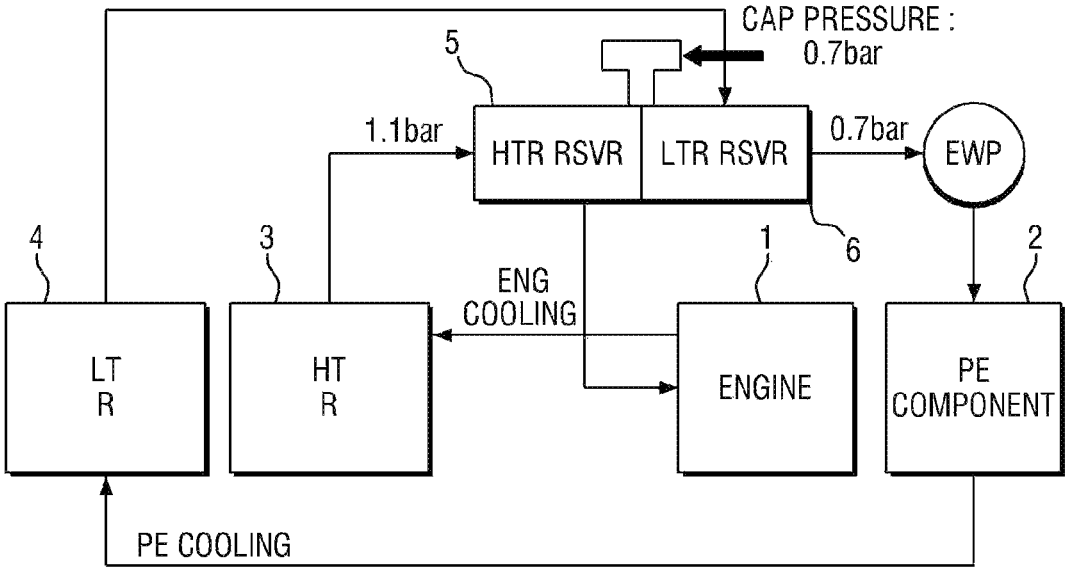
FIG. 8 is a diagram illustrating a configuration of a cooling line system of a vehicle using the integrated type reservoir according to the present disclosure.

Hereinafter, an operation of the integrated type reservoir 10 according to the present disclosure configured as such will be described in detail. FIG. 8 is a diagram illustrating a configuration of a cooling line system of the vehicle using the integrated type reservoir according to the present disclosure.

Referring to the drawing, the integrated type reservoir 10 of the present disclosure continuously stores a predetermined amount of coolant, and prevents the negative pressure of the cooling system from being generated. The integrated type reservoir may be installed on a cooling line for cooling the engine 1 in a hybrid vehicle such as a Hybrid Electronic Vehicle (HEV), and a cooling line for cooling various PE components 2, such as a motor, a DC-DC converter, an inverter, or a high voltage battery.

Particularly, the coolant flowing from the high-temperature radiator 3 of the engine cooling line to the first inlet pipe 25 provided in the upper case 20 of the integrated type reservoir 10 according to the present disclosure may be introduced into the high-pressure reservoir space V1 having the pressure of 1.1 bar, and the coolant flowing from the low-temperature radiator 4 of the PE cooling line to the second inlet pipe 26 provided in the upper case 20 may be introduced into the low-pressure reservoir space V2 having the pressure of 0.7 bar. The pressure of the cap 50 attached to the integrated type reservoir 10 is about 0.7 bar.

The integrated type reservoir 10 of the present disclosure may discharge the coolant accommodated in the high-pressure reservoir space V1 through the first outlet pipe 35 disposed in the lower case 30 to the cooling line of the engine 1, and discharge the coolant accommodated in the low-pressure reservoir space V2 through the second outlet pipe 36 disposed in the lower case 30 to the cooling line of the PE component 2. Accordingly, the operation of regulating the pressure of the engine cooling line and the PE cooling line using the integrated type reservoir 10 according to the present disclosure will be described.

Figure 9A:
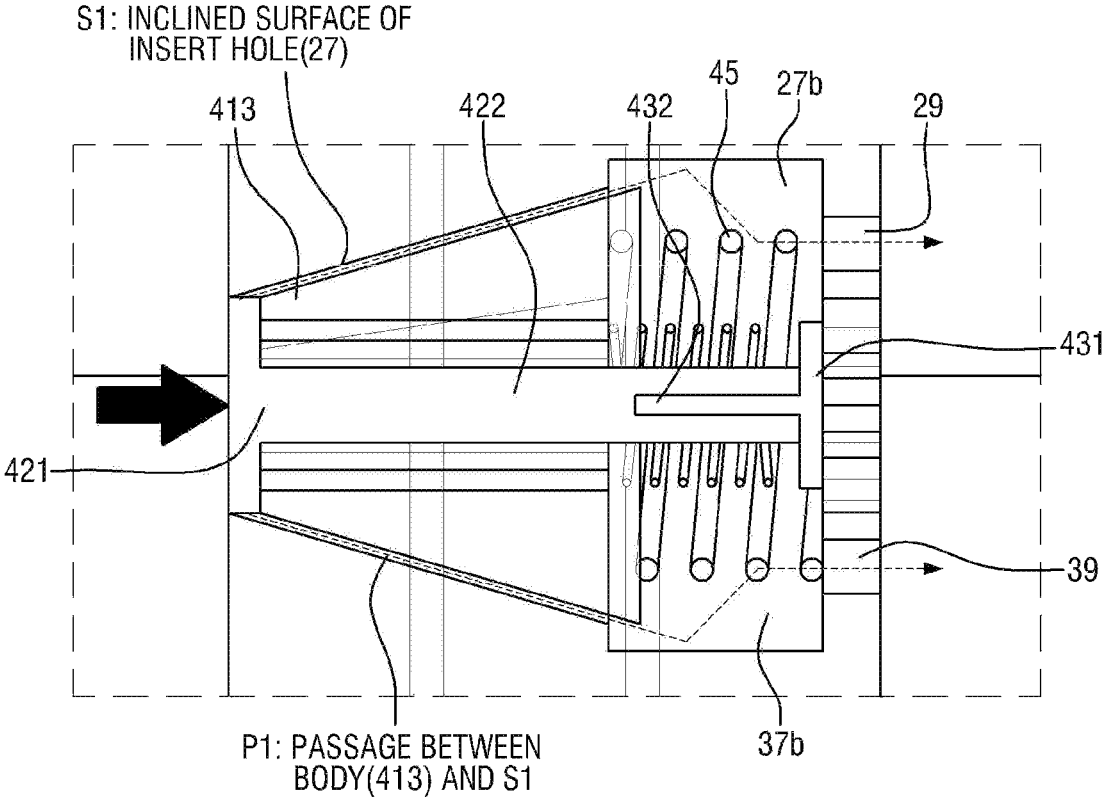
FIG. 9A is a diagram illustrating the operating state when the high-pressure reservoir is at positive pressure according to the present disclosure.
Figure 9B:
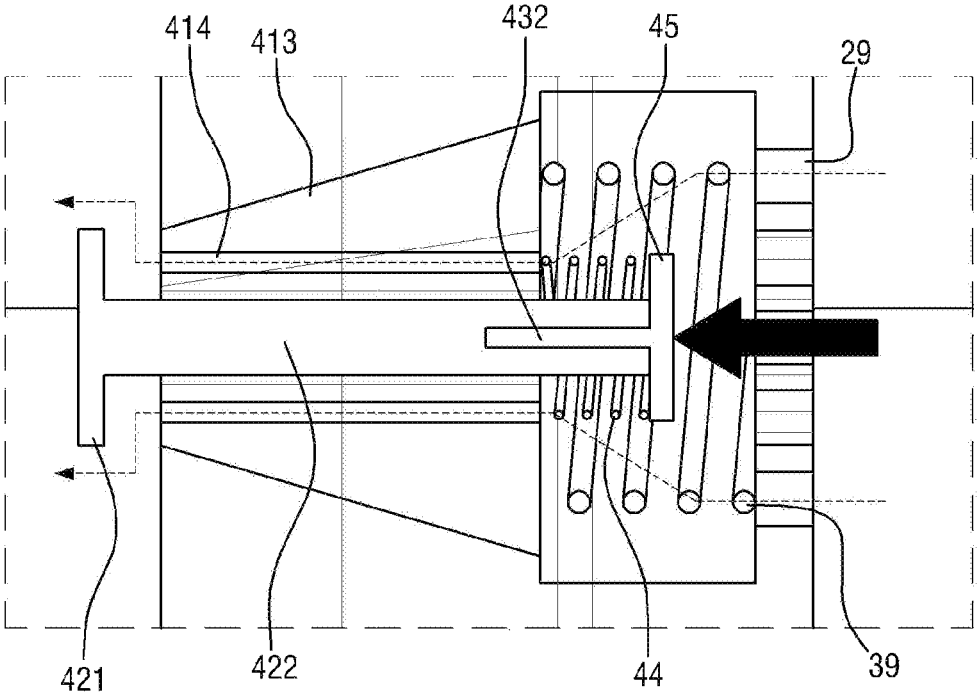
FIG. 9B is a diagram illustrating the operating state when the low-pressure reservoir is at positive pressure according to the present disclosure.

FIGS. 9A and 9B are diagrams illustrating the operating state of the valve of the integrated type reservoir according to the present disclosure, in which FIG. 9A is a diagram illustrating the operating state when the high-pressure reservoir is at positive pressure, and FIG. 9B is a diagram illustrating the operating state when the low-pressure reservoir is at positive pressure.

As described above, the integrated type reservoir 10 according to the exemplary embodiment of the present disclosure is assumed that the internal pressure of the high-pressure reservoir space V1 is about 1.1 bar and the internal pressure of the low-pressure reservoir space V2 is about 0.7 bar in the state where the system pressure of the engine cooling line is set to about 1.1 bar and the pressure of the PE cooling line is set to about 0.7 bar. Furthermore, a state in which the internal pressure of the high-pressure reservoir space V1 according to the exemplary embodiment of the present disclosure is greater than about 1.1 bar that is reference pressure is referred to as a positive pressure state, and a state in which the internal pressure is less than about 0.7 bar is referred to as a negative pressure state.

First, referring to FIG. 9A illustrating the operating state when the high-pressure reservoir is at positive pressure, if the internal pressure of the high-pressure reservoir space V1 exceeds a preset value, namely, about 1.1 bar, the positive pressure is applied to the top surface 412 of the release valve 41 facing the corresponding space V1. Then, if the upper piece 421 of the push valve 42 coupled to the top surface 412 of the release valve 41 is pushed towards the low-pressure reservoir space V2 by the positive pressure applied to the corresponding space V1, the body 413 of the release valve 41 coupled to the push valve 421 is also moved towards the low-pressure reservoir space V2.

Moreover, an inclined vent path P1 may be formed between an inclined surface s1 of each of the insert grooves 27 and 37 and the body 413 of the release valve 41 by the movement of the release valve 41. The air of the high-pressure reservoir space V1 flows through the corresponding vent path P1 into each of the insert grooves 27 and 37. The air flowing to each of the insert grooves 27 and 37 may be discharged through each of the flow apertures 29 and 39 formed in the sidewalls 28 and 38 of the insert grooves to the low-pressure reservoir space V2.

Therefore, as the positive internal pressure of the high-pressure reservoir space V1 is reduced through the low-pressure reservoir space V2, the normal internal pressure of the preset about 1.1 bar may be maintained. In particular, since the release valve 41 is subjected to an elastic force acting in the direction of the high-pressure reservoir space V1 by the outer spring 45, the pressure exceeding about 1.1 bar of the corresponding space V1 is released, and the body 413 of the release valve 41 returns to an original position while moving towards the high-pressure reservoir space V1. Thus, the vent path P1 defined between the inclined surface s1 of each of the insert grooves 27 and 37 and the body 413 of the release valve 41 may be closed and thus, the discharge of the air to the low-pressure reservoir space V1 may be stopped.

Next, the corresponding operation will be described with reference to FIG. 9B when the low-pressure reservoir space V1 is at positive pressure. If the internal pressure of the low-pressure reservoir space V1 exceeds the preset about 0.7 bar, the positive pressure is applied to the head piece 431 of the pin body 43 facing the corresponding space V2. Then, the pin body 43 is pushed towards the high-pressure reservoir space V1 by the positive pressure applied to the head piece 431, so that the push valve 42 coupled to the pin body 43 is also moved towards the high-pressure reservoir space V1.

Then, the upper piece 421 of the push valve 42 is moved together in the direction of the high-pressure reservoir space V1 by the movement of the push valve 42, and thus, the vent aperture 415 of the high-pressure reservoir space V1 of the release valve 41 may be opened. Therefore, the air of the low-pressure reservoir space V2 flows through the flow apertures 29 and 39 formed in the sidewalls 28 and 38 around the insert groove and the insert grooves 27 and 37, and may be discharged through the vent aperture 415 to the high-pressure reservoir space V1. Therefore, while the positive internal pressure of the low-pressure reservoir space V2 is reduced by a discharge through the high-pressure reservoir space V1, the normal internal pressure of the preset about 0.7 bar may be maintained.

Meanwhile, since the pin body 43 is subjected to the elastic force in the direction of the low-pressure reservoir space V2 by the inner spring 44, the pressure of the corresponding space V2 exceeding about 0.7 bar is released and the pin body 43 may be restored to an original position while being moved towards the low-pressure reservoir space V2. Further, if the push valve 42 coupled to the pin body 43 moves along the pin body 43 towards the low-pressure reservoir space V2 and thus the upper piece 421 of the push valve 42 closes the vent aperture 415, the discharge of the air through the vent hole 415 to the high-pressure reservoir space V1 may be stopped.

Figure 10A:
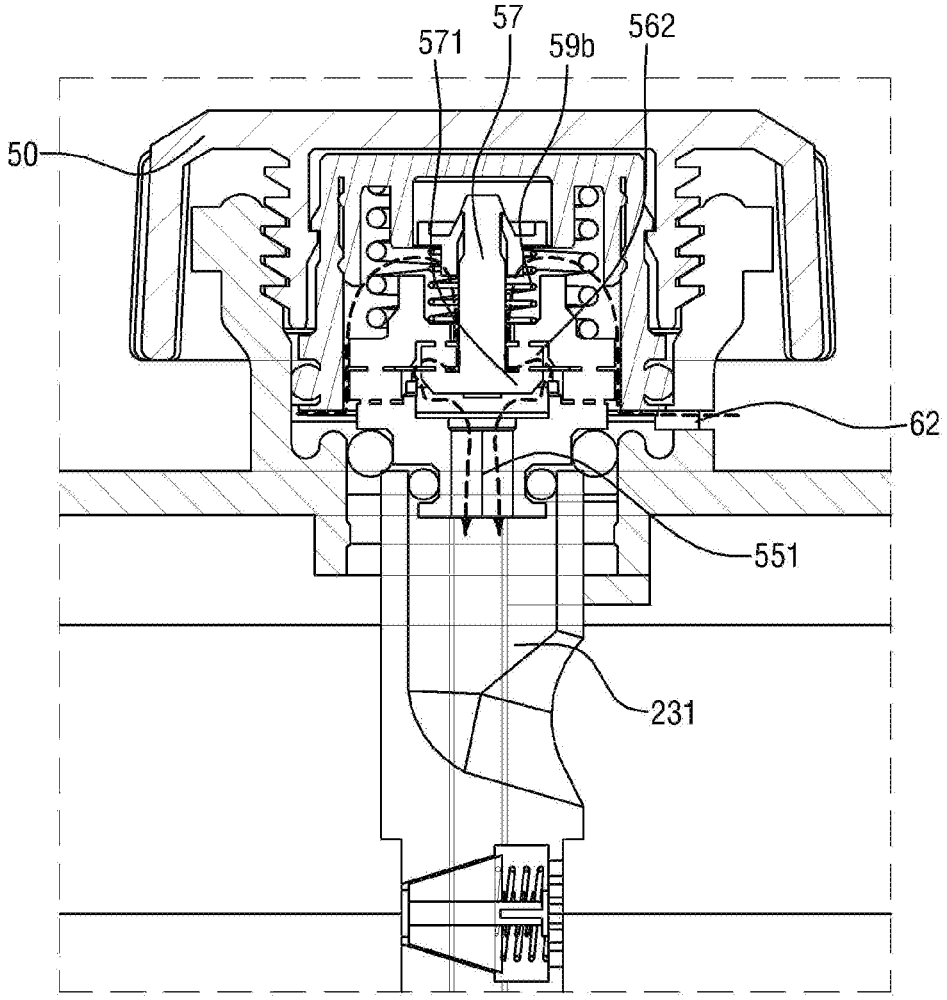
FIG. 10A is a diagram illustrating the operating state when the low-pressure reservoir is at negative pressure according to the present disclosure.
Figure 10B:
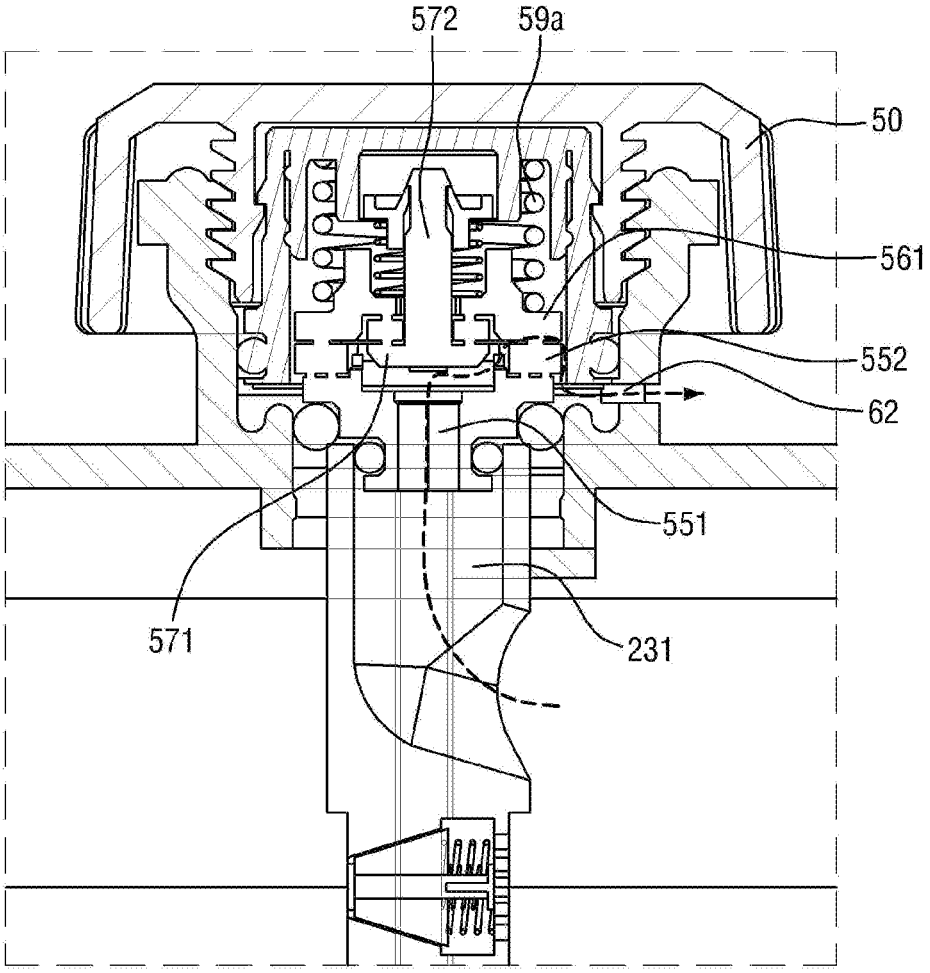
FIG. 10B is a diagram illustrating the operating state when the low-pressure reservoir is at positive pressure according to the present disclosure.
Figure 10C:
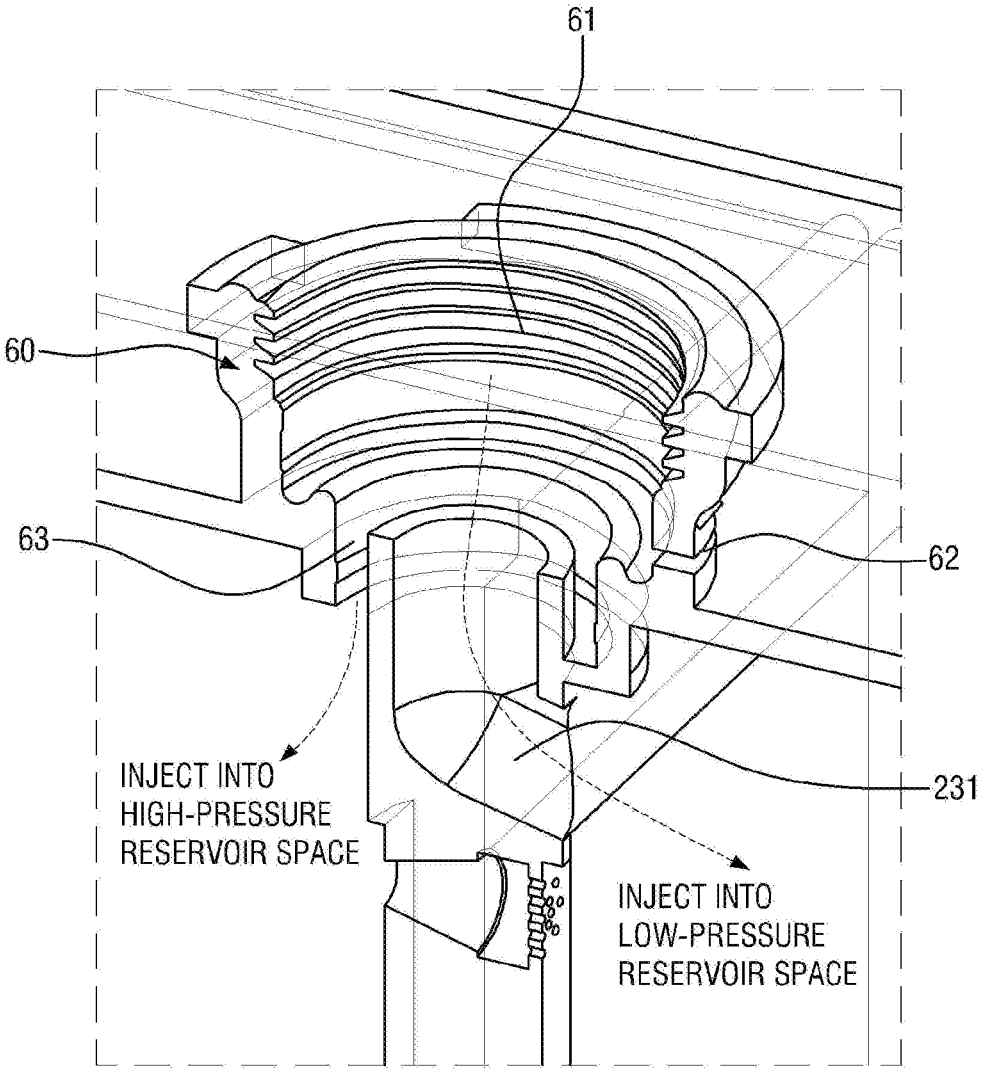
FIG. 10C is a diagram illustrating the operating state of the cap when coolant is injected into the reservoir according to the present disclosure.

FIGS. 10A to 10C are diagrams illustrating the operating state of the cap of the integrated type reservoir according to the present disclosure, in which FIG. 10A is a diagram illustrating the operating state when the low-pressure reservoir is at negative pressure, FIG. 10B is a diagram illustrating the operating state when the low-pressure reservoir is at positive pressure, and FIG. 10C is a diagram illustrating the operating state of the cap when coolant is injected into the reservoir.

Referring to the drawing, the cap 50 according to the exemplary embodiment of the present disclosure regulates the internal pressure of the low-pressure reservoir space V2 by circulating the external air of the integrated type reservoir 10 and the air of the low-pressure reservoir space V2. The cap 50 according to the exemplary embodiment of the present disclosure performs an operation for regulating the internal pressure of the low-pressure reservoir space V2 to about 0.7 bar.

First, referring to FIG. 10A, the cam 57 installed in the cap valve part 54 of the cap 50 according to the present disclosure is subjected to the elastic force so that the internal pressure of the cap 50 maintains about 0.7 bar by the sub spring 59*b* provided on the head piece 571. In this state, if the internal pressure of the low-pressure reservoir space V2 is in the negative pressure below about 0.7 bar, the pressure of the low-pressure reservoir space V2 is less than the internal pressure of the cap 50, and thus, the sub spring 59*b* is relaxed by the internal pressure of the cap 50 that is high in pressure and the head piece 571 of the cam 57 is pushed downwards.

Then, the second locking surface 562 of the intermediate body 56 displaces from a state in which it comes into contact with the head piece 571 of the cam 57 to a state in which it is separated from the head piece 571 of the cam 57. The external air of the integrated type reservoir 10 flows from the orifice 62 formed in the cap coupler 60 through the internal space of the upper member 58 and the outside of the piston 572 of the cam 57 into a gap between the second locking surface 562 and the head piece 571 of the cam 57, and then is discharged through the flow aperture 551 of the base 55 to the flow path 231 of the upper partition wall 23, and thus, the air is introduced into the low-pressure reservoir space V2.

Subsequently, if the internal pressure of the low-pressure reservoir space V2 with air being introduced increases, and the internal pressure of the corresponding space V2 reaches the preset pressure, namely, about 0.7 bar, the head piece 571 of the cam 57 returns upwards by the elastic force of the sub spring 59*b* moved from the relaxed state to the contracted state since the internal pressure of the cap 50 is equal to the internal pressure of the low-pressure reservoir space V2. Thus, the head piece 571 of the cam 57 comes into contact with the second locking surface 562 of the intermediate body 56 again to shut off the flow of the air to the flow aperture 551 of the base 55.

Further, the operating state when the low-pressure reservoir is at positive pressure will be described with reference to FIG. 10B. The intermediate body 56 installed in the cap valve part 54 of the cap 50 according to the present disclosure is subjected to the elastic force so that the internal pressure of the cap 50 may maintain about 0.7 bar by the main spring 59*a* interposed between the top surface of the lower surface 561 and the ceiling surface 582 of the upper member 58. In this state, if the internal pressure of the low-pressure reservoir space V2 is in the positive pressure greater than about 0.7 bar, the air acts on the head piece 571 of the cam 57 through the flow aperture 551 of the base 55 by the internal pressure of the low-pressure reservoir space V2 that is high in pressure since the pressure of the low-pressure reservoir space V2 is greater than the internal pressure of the cap 50. Thus, the cam 57 may be pushed upwards while the main spring 59*a* is contracted Then, the second locking surface 562 of the intermediate body 56, which has come into contact with the head piece 571 of the cam 57, may be moved upwards by the movement of the cam 57, and the intermediate body 56 to which the second locking surface 562 is attached may also be moved upwards. Then, the first locking surface 552 of the base 55, which has come into contact with the lower surface 561 of the intermediate body 56, is spaced apart from the lower surface 561 due to the upward movement of the intermediate body 56. The internal air of the low-pressure reservoir space V2 flows through a gap between the flow path 231 and the flow aperture 551 of the base 55 and a gap between the first locking surface 552 and the lower surface 561, and may be discharged through the orifice 62 of the cap coupler 60 to the outside of the integrated type reservoir 10.

Subsequently, if the internal pressure of the low-pressure reservoir space V2 that is discharging the air is reduced and the internal pressure of the corresponding space V2 reaches the preset pressure, namely, about 0.7 bar, the head piece 571 of the cam 57 returns downwards by the elastic force generated when the contracted main spring 59*a* is relaxed to an original state since the internal pressure of the cap 50 is equal to the internal pressure of the low-pressure reservoir space V2. Thus, the second locking surface 562 of the intermediate body 56, which has come into contact with the head piece 571 of the cam 57, may be moved downwards by the movement of the cam 57, and the intermediate body 56 to which the second locking surface 562 is attached may also be moved downwards.

Additionally, the first locking surface 552 of the base 55, which has come into contact with the lower surface 561 of the intermediate body 56, comes into contact with the lower surface 561 again due to the downward movement of the intermediate body 56, thus preventing the internal air of the low-pressure reservoir space V2 from being discharged to the outside of the integrated type reservoir 10 through the flow path 231, the flow aperture 551, and the orifice 62. Therefore, since the integrated type reservoir 10 of the present disclosure automatically regulates the internal pressure of the high-pressure reservoir space V1 and the low-pressure reservoir space V2 of the reservoir 10 by the valve 40 and the cap 50, it may be possible to efficiently perform the unique function of the reservoir. In other words, it may be possible to efficiently discharge pressure at positive pressure and suction pressure at negative pressure.

Meanwhile, the following table 1 summarizes the operating state of the integrated type reservoir 10 of the present disclosure based on the internal pressure of the high-pressure reservoir space V1 and the low-pressure reservoir space V2. Table 1 shows that the valve 40 and the cap 50 of the integrated type reservoir 10 according to the present disclosure are operated in conjunction with each other depending on the internal pressure of the corresponding space.

TABLE 1

| Low-pressure reservoir space Pressure condition (right)→ High-pressure reservoir space Pressure condition (down)↓ | <0.7 bar (negative pressure) | 0.7 bar (normal) | >0.7 bar (positive pressure) |
|---|---|---|---|
| >1.1 bar (positive pressure) | Operations of valve of FIG. 9A and cap of FIG. 10A are simultaneously performed | If valve of FIG. 9A is operated so that internal pressure of low-pressure reservoir space rises to positive pressure, cap of FIG. 10B is operated | Operations of valve of FIG. 9A and cap of FIG. 10B are simultaneously performed |

TABLE 1-continued

| Low-pressure reservoir space Pressure condition (right)→ High-pressure reservoir space Pressure condition (down)↓ | <0.7 bar (negative pressure) | 0.7 bar (normal) | >0.7 bar (positive pressure) |
|---|---|---|---|
| 1.1 bar (normal) | Cap of FIG. 10A is operated | Normal state | Cap of FIG. 10B is operated |
| <1.1 bar (negative pressure) | Operations of valve of FIG. 9B and cap of FIG. 10A simultaneously performed | If valve of FIG. 9B is operated so that are internal pressure of low-pressure reservoir space drops to negative pressure, cap of FIG. 10A is operated | Operations of valve of FIG. 9B and cap of FIG. 10B are simultaneously performed |

Meanwhile, FIG. 10C is a diagram illustrating the operating state of the cap when the coolant is injected into the integrated type reservoir of the present disclosure. When the coolant is injected into the high-pressure reservoir space V1 and the low-pressure reservoir space V2 of the integrated type reservoir 10 according to the present disclosure, the holder 51 of the cap 50 fastened to the cap coupler 60 of the upper case 20 of the integrated type reservoir 10 rotates counterclockwise, and thus, the thread 531 of the sidewall 53 of the cap 50 disengages from the internal thread 611 formed on the coupling wall 61 of the cap coupler 60. Then, the cap 50 may be separated from the cap coupler 60, and the flow path 231 formed in the upper partition wall 23 and the coolant refill aperture 63 formed in the upper plate 21 are exposed as shown in the drawings. The exposed flow path 231 forms an input port to refill the coolant into the low-pressure reservoir space V2, and the coolant refill hole 63 forms an input port to refill the coolant into the high-pressure reservoir space V1.

Therefore, as described above, if a user adds the coolant into the coupling wall 61 of the cap coupler 60 with the flow path 231 and the coolant refill aperture 63 being exposed, some of the input coolant flows through the flow path 231 into the low-pressure reservoir space V2, and remaining coolant flows through the coolant refill hole 63 into the high-pressure reservoir space V1, thus simultaneously refilling the coolant into both the low-pressure reservoir space V2 and the high-pressure reservoir space V1 of the integrated type reservoir 10. Of course, in the state where the cap 50 is separated, the coolant may be added into the low-pressure reservoir space V2 using the flow path 231, and the coolant may be added into the high-pressure reservoir space V1 using the coolant refill aperture 63 to refill the coolant in each corresponding space.

What is claimed is:

1. An integrated type reservoir, comprising:

an upper case and a lower case joined to each other to form a body in which the integrated type reservoir is accommodated;

a high-pressure reservoir space configured to introduce and discharge coolant flowing from a high pressure cooling line, and a low-pressure reservoir space configured to introduce and discharge coolant flowing from a low pressure cooling line; and a valve installed to maintain internal pressure of the high-pressure reservoir space and the low-pressure reservoir space constant, wherein the high pressure cooling line is a cooling line that introduces coolant flowing from a high-temperature radiator and discharges the coolant through the high-pressure reservoir space to a cooling line of an engine, and wherein the low pressure cooling line is a cooling line that introduces coolant flowing from a low-temperature radiator and discharges the coolant through the low-pressure reservoir space to a cooling line of a power electronic (PE) component.

2. The integrated type reservoir of claim 1, wherein the upper case includes an upper plate, and an upper partition wall extending downwards from a central portion of an inner surface of the upper plate to be perpendicular thereto, forming an end face, and wherein the lower case includes a lower plate, and a lower partition wall extending upwards from a central portion of a surface of the lower plate to be perpendicular thereto, forming an end face, and wherein the upper case and the lower case are attached to each other, and an internal space of the reservoir is divided into two spaces by the upper partition wall and the lower partition wall which are attached to each other.

3. The integrated type reservoir of claim 2, wherein a valve insert groove is formed on the end face of the upper partition wall of the upper case and an upper portion of the valve is seated thereon, and wherein a valve insert groove is formed on the end face of the lower partition wall of the lower case and a lower portion of the valve is seated thereon, and wherein flow apertures passing through sidewalls are formed, respectively, in the sidewall of a portion in which the valve insert groove of the upper partition wall is formed, and the sidewall of a portion in which the valve insert groove of the lower partition wall is formed.

4. The integrated type reservoir of claim 2, wherein the cap is coupled to a cap coupler provided on the upper plate of the upper case, and wherein the cap includes:

a holder that has a shape of a flat plate with an edge extending downwards, a sidewall that extends downwards from the holder, with a thread formed thereon, and a cap valve part that is installed in a space defined inside the sidewall to be opened or closed according to the internal pressure of the low-pressure reservoir space and the high-pressure reservoir space in the reservoir to discharge air of the low-pressure reservoir space to an outside of the cap or introduce external air into the low-pressure reservoir space.

5. The integrated type reservoir of claim 4, wherein the cap valve part includes:

a base having a flow aperture that is formed to communicate with a flow path formed in the upper partition wall to be opened towards the low-pressure reservoir space, with a first locking surface being formed on an upper surface of the base;

an intermediate body installed on a top of the base, and having a lower surface that comes into contact with the first locking surface, and a second locking surface that extends into the lower surface to come into contact with a head piece of the cam;

an upper member having an inner wall coupled to the sidewall and a ceiling surface integrated with the inner wall; and a main spring interposed between a top of the lower surface of the intermediate body and the ceiling surface of the upper member to rotate the intermediate body upwards and downwards.

6. The integrated type reservoir of claim 5, wherein the cap valve part includes:

a cam having a plate-shaped head piece that is inserted into the intermediate body to be locked by the second locking surface of the intermediate body, and a piston that extends upwards from the head piece; and a sub spring interposed between a ring body through which an upper end of the piston of the cam passes and the head piece of the cam to rotate the cam upwards and downwards.

7. The integrated type reservoir of claim 5, further comprising an O-ring that shields a coolant refill aperture of the high-pressure reservoir space of the cap coupler.

8. The integrated type reservoir of claim 4, wherein the cap coupler includes:

a coupling wall that has an internal thread formed to be coupled with the cap and extends upwards from the upper plate of the upper case; and an orifice that is formed through the coupling wall to allow air to flow into the low-pressure reservoir space.

9. The integrated type reservoir of claim 8, wherein the coolant refill aperture is formed through the upper plate of the upper case to refill the coolant into the high-pressure reservoir space.

10. The integrated type reservoir of claim 1, wherein a first inlet pipe is formed on a first side of the upper case to introduce the coolant from the high-temperature cooling line into the high-pressure reservoir space, and a second inlet pipe is formed on a second side of the upper case to introduce the coolant from the low-temperature cooling line into the low-pressure reservoir space, and wherein a first outlet pipe is formed on a first side of the lower case to discharge the coolant to the high-pressure cooling line, and a second outlet pipe is formed on a second side of the lower case to discharge the coolant to the low-pressure cooling line.

11. The integrated type reservoir of claim 1, wherein the valve includes a release valve, and wherein the release valve has a body with a bottom surface and a top surface, an insert aperture passing from the bottom surface to the top surface is formed in a central portion of the body, and a plurality of vent apertures are formed around the insert aperture, and wherein an outer spring is provided, a first side of the outer spring facing the bottom surface and a second side facing the sidewalls of the insert grooves.

12. The integrated type reservoir of claim 11, wherein a push valve is coupled to the insert aperture of the release valve, and wherein the push valve includes a flat plate-shaped upper piece that opens or closes the vent aperture on the top surface of the release valve, and an arm that extends downwards from a bottom surface of the upper piece and has a pinhole formed inwards from the end face.

13. The integrated type reservoir of claim 12, wherein a pin body is coupled to the arm of the push valve, and the pin body includes a head piece that comes into contact with the end face of the arm, and a pin that extends downwards from a bottom surface of the head piece and is inserted into the pinhole of the arm, and wherein the inner spring is fitted into the outer spring on the bottom surface of the release valve, a first side of the inner spring facing the bottom surface and a second side facing the head piece of the pin body.

14. The integrated type reservoir of claim 11, wherein, assuming that an area of the bottom surface of the release valve is referred to as an 'area B' (unit: $m^2$), an area of the top surface is referred to as an 'area A' (unit: $m^2$), internal pressure of the high-pressure reservoir space is referred to as an 'X' Pa (unit: $N/m^2$), and internal pressure of the low-pressure reservoir space is referred to as a 'Y' Pa (unit: $N/m^2$), the internal pressure of each space is regulated by a force balance equation such as the following Equation 1.

$$X^*(\text{area } A)=Y^*(\text{area } B)+S$$

* Legend

S: an elastic force of the inner spring (unit: N)

* * * * *